US007475742B2

(12) United States Patent
Angman et al.

(10) Patent No.: US 7,475,742 B2
(45) Date of Patent: Jan. 13, 2009

(54) METHOD FOR DRILLING WITH CASING

(75) Inventors: Per G. Angman, Calgary (CA); Robert Tessari, Calgary (CA)

(73) Assignee: Tesco Corporation, Houston, TX (US)

( * ) Notice: Subject to any disclaimer, the term of this patent is extended or adjusted under 35 U.S.C. 154(b) by 61 days.

(21) Appl. No.: 11/279,223

(22) Filed: Apr. 10, 2006

(65) Prior Publication Data

US 2007/0051538 A1 Mar. 8, 2007

Related U.S. Application Data

(63) Continuation-in-part of application No. 10/297,629, filed as application No. PCT/CA01/00681 on May 14, 2001, now Pat. No. 7,044,241.

(60) Provisional application No. 60/595,745, filed on Aug. 2, 2005.

(30) Foreign Application Priority Data

Jun. 9, 2000 (CA) ..... 2311158

(51) Int. Cl.
*E21B 7/04* (2006.01)
*E21B 7/20* (2006.01)

(52) U.S. Cl. ..... 175/61; 175/171; 166/380; 166/381

(58) Field of Classification Search ..... 175/61, 175/171, 57, 257, 258, 62; 166/381, 117, 166/242.6, 380; 405/228
See application file for complete search history.

(56) References Cited

U.S. PATENT DOCUMENTS 2,277,989 A 3/1942 Kinnear
2,929,610 A * 3/1960 Stratton ..... 166/354
2,950,087 A 8/1960 Gregory
2,988,145 A * 6/1961 Clark, Jr. et al. ..... 175/317
3,050,143 A * 8/1962 Kammerer et al. ..... 175/261
3,169,592 A * 2/1965 Kammerer ..... 175/257
3,213,160 A 10/1965 Kammerer
3,340,928 A * 9/1967 Brown ..... 166/352
3,945,444 A 3/1976 Knudson
4,544,041 A * 10/1985 Rinaldi ..... 175/57
4,595,059 A 6/1986 Katagiri et al.
4,904,119 A 2/1990 Legendre et al.
5,168,942 A 12/1992 Wydrinski
5,197,553 A * 3/1993 Leturno ..... 175/57
5,271,472 A 12/1993 Leturno
5,339,909 A 8/1994 Rinaldi
5,456,326 A 10/1995 Raines
5,590,726 A 1/1997 Jarvela et al.
5,718,291 A * 2/1998 Lorgen et al. ..... 166/377
5,921,332 A 7/1999 Spedale, Jr.
5,950,742 A 9/1999 Caraway
6,120,214 A * 9/2000 Iovino ..... 405/241

FOREIGN PATENT DOCUMENTS

WO WO 00/50730 8/2000

* cited by examiner

*Primary Examiner*—Kenneth Thompson
(74) *Attorney, Agent, or Firm*—Bracewell & Giuliani LLP

(57) ABSTRACT

A method for drilling boreholes using casing as the drill string and for removing a drilling assembly from the wellbore while leaving the casing in the well bore. In the method, the drilling assembly is prepared for removal from the wellbore by launching a release tool and manipulating the drilling assembly using the release tool.

27 Claims, 5 Drawing Sheets

METHOD FOR DRILLING WITH CASING

CROSS REFERENCE TO RELATED APPLICATIONS

This is a continuation-in-part of U.S. Ser. No. 10/297,629, filed Jul. 29, 2003, which is a 371 of PCT/CA01/00681, filed May 14, 2001 and claims foreign convention priority of Canadian patent application 2,311,158, filed Jun. 9, 2000. This application claims priority from U.S. Provisional application Ser. No. 60/595,745, filed Aug. 2, 2005.

FIELD OF THE INVENTION

This invention relates to a method for wellbore drilling and, in particular, a method for drilling a wellbore using casing as the drill string.

BACKGROUND OF THE INVENTION

The drilling of wells, for example, for oil and gas production conventionally employs relatively small diameter strings of drill pipe to which is secured a drill bit of somewhat larger diameter. After a selected portion of the wellbore has been drilled, the well bore is usually lined with a string of tubulars known as casing. The casing (herein used to encompass any wellbore liner) has a smaller diameter than the drill bit. This conventional system which requires sequentially drilling the borehole using drill pipe with a drill bit attached thereto, pulling the drill pipe out of the borehole and running casing into the borehole is time consuming and costly. In addition, control of the well is difficult during the period that the drill pipe is being removed and the casing is being run in.

Drilling with casing is gaining popularity as a method for drilling wherein the casing is used as the drill string and drilling conduit and, after drilling, the casing remains downhole to act as the wellbore liner. A drilling assembly, including a drill bit and one or more hole enlargement tools such as, for example, an underreamer, is used which drills a borehole of sufficient diameter to accommodate the casing. The drilling assembly is deployed on the advancing end of the casing. The drill bit can be retractable and/or removable through the casing.

Casing drilling has been tested for drilling vertical, straight and deviated wellbores.

Recently, as described in copending PCT application s.n. PCT/CA99/00636, a process has been invented for drilling directional holes using casing as a drill string. According to that process a directional borehole assembly and a drilling assembly are connected to the distal end of a drill string. The directional borehole assembly includes a biasing means for applying a force to the drilling assembly to drive it laterally relative to the wellbore. The directional borehole and drilling assemblies can include drill bits with rotary steerable tools or downhole motors equipped with bent housings and/or bent subs that permit control of forces acting perpendicular to the drill string to steer the drill bit in a selected direction while drilling.

In liner drilling, the drilling assemblies operate and advance to extend the borehole while being mounted on the end of a section of liner. The liner is connected to surface by a length of drill pipe or additional casing.

SUMMARY OF THE INVENTION

In accordance with a broad aspect of the present invention, there is provided a method for drilling a well with a well casing as at least a portion of an elongated tubular drill string and a drilling assembly retrievable from the lower distal end of the drill string without withdrawing the well casing from a wellbore being formed by the drilling assembly, the method comprising: providing the casing as at least a portion of the drill string; providing the drill string with the drilling assembly engaged at the distal end thereof; with the drill string and the drilling assembly in the wellbore, driving the drilling assembly to operate at the bottom of the wellbore to extend the wellbore, the wellbore being formed having a diameter greater than the diameter of the drill string; actuating the drilling assembly to disengage from the distal end of the drill string including launching a release tool and manipulating the drilling assembly using the release tool; removing the drilling assembly out of the wellbore through the drill string without removing the drill string from the wellbore; and leaving the casing portion of the drill string in the wellbore.

In accordance with another broad aspect of the present invention, there is provided a method for positioning a casing string within a wellbore, the wellbore having been drilled using the casing string as at least a portion of an elongated tubular drill string and a drilling assembly connected to the drill string and retrievable from the lower distal end of the drill string without withdrawing the casing string from the wellbore being formed by the drilling assembly, the method comprising: after drilling a wellbore, releasing the drilling assembly from engagement with the drill string including launching a release tool and manipulating the drilling assembly using the release tool; and removing the drilling assembly from the. wellbore through the drill string without removing the casing string portion of the drill string from the wellbore.

In accordance with another broad aspect of the present invention, there is provided a method for positioning a casing string within a wellbore, the wellbore having been drilled using the casing string as at least a portion of an elongated tubular drill string and a drilling assembly connected to the drill string and retrievable from the lower distal end of the drill string without withdrawing the casing string from the wellbore being formed by the drilling assembly, the method comprising: after drilling a wellbore, releasing the drilling assembly from engagement with the drill string including launching a fluid-conveyed dart with a release functionality and manipulating the drilling assembly using the fluid-conveyed dart; and removing the drilling assembly from the wellbore through the drill string without removing the casing string portion of the drill string from the wellbore.

BRIEF DESCRIPTION OF THE DRAWINGS

A further, detailed, description of the invention, briefly described above, will follow by reference to the following drawings of specific embodiments of the invention. These drawings depict only typical embodiments of the invention and are therefore not to be considered limiting of its scope. In the drawings.

DETAILED DESCRIPTION OF THE PRESENT INVENTION

Figure 1:
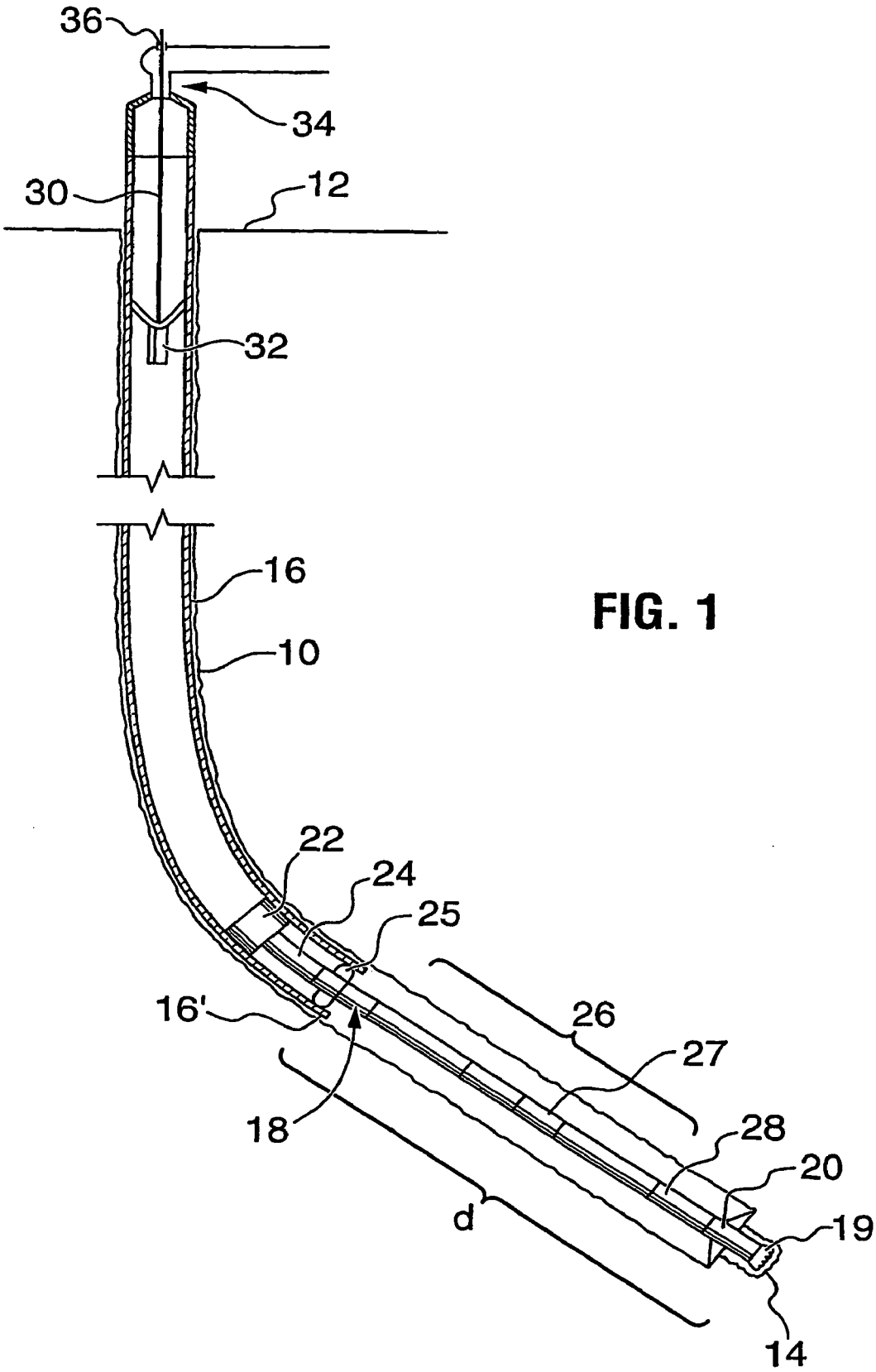
FIG. 1 shows a schematic, vertical section through a well and illustrates aspects of a drilling process according to the present invention.

A method for drilling boreholes using casing has been invented. The term casing is used herein to encompass any wellbore liner capable of supporting an operational drilling assembly. The present invention provides a method to facilitate removal of a drilling assembly from a well. This method can be used whenever it is desired to remove the drilling assembly from the wellbore such as when drilling assembly maintenance is required or when drilling is complete.

The drilling assembly includes drill bits such as, for example, a pilot bit and underreamers and can include any of: directional assemblies such as rotary steerable tools or downhole motors equipped with bent housings and/or bent subs; mud motors; measurement while drilling (MWD) instruments; and other downhole tools.

As is known, drilling assemblies are attached to the drill strings in various ways such as, for example, by locking dogs latching in recesses in the casing. A release tool is generally used to retract the locking arrangement of the drilling assembly from engagement with the drill string.

In wellbore drilling it is preferable that fluid circulation be maintained even during periods in which the drill bit is not operating. Fluid circulation acts to condition the well, remove debris and prevent cave in. Therefore, in one aspect of the present invention the disengagement of the drilling assembly from the drill string is carried out using a means that permits circulation during the actuation operation. Further, the chances of a cave-in increase with increased time between stopping the drilling operation and either reinitiating drilling, advancing the casing or completing the wellbore. Therefore, a process may be useful where the step of disengaging the drilling assembly from the drill string is minimised with respect to time required. In other words, a process for releasing the drilling assembly from engagement with the drill string is preferred that minimises time taken. The use of a work string, such as coiled tubing, wireline, small diameter pipe, etc., requires that the work string be fully removed from the casing before some further operations may be initiated, such as addition of joints of casing, or drill pipe in the case of liner drilling to advance the drill string. Thus, any process that uses a work string inserted through the casing requires more time than one not using an inserted work string. Thus, a process is preferred wherein the step of disengagement is accomplished without the use of a work string. These processes permit continued circulation during actuation of release of the drilling assembly from the drill string. In addition, these processes do not require a delay between release of the drilling assembly from the drill string and further operations such as for example advancement of the drill string over the drilling assembly. The step of disengagement can include for example, releasing a fluid or gravity conveyed tool such as a ball, spear, a drop bar or a fluid-conveyed dart or actuation by a mud pulse, or electromagnetic or electrical actuation. A ball can be dropped where the wellbore is substantially vertical. Where the wellbore contains some deviations, the use of a fluid-conveyed dart is preferred. The use of a mud pulse, electrical signal or an electromagnetic signal can be used but will require the use of a drilling assembly which can recognize the signal to disengage.

Referring to FIG. 1, a wellbore 10 is shown during a drilling operation. Wellbore 10 extends between surface 12 and bottom 14 of the wellbore. A drill string 16 formed of casing extends from surface into the wellbore. A drilling assembly 18 is connected at the distal end 16' of the drill string and extends a distance d from distal end 16' to total depth 14. Drilling assembly 18 includes a pilot bit 19 and a plurality of underreamers 20. Also included in drilling assembly are a drill lock member 22 for engaging the drilling assembly to the drill string, a drill collar 24, a stabilizer 25, a non-magnetic drill collar 26 including an MWD survey instrument and mud pulse generator 27 and a mud motor 28 for driving the bits 19 and 20. In such an arrangement the distance d is about 100 to 120 feet.

Drilling assembly 18 is connected into drill string 16 by means of latches on drill lock member 22. As will be appreciated by a person skilled in the art, the latches are activated to retract by manipulation of member 22.

Member 22 can be manipulated by running in a work string 30 such as drill pipe, coiled tubing, wireline, etc. including a release tool 32 attached thereto. As is known, release tool 32 manipulates member 22 such that the latches are driven to retract out of engagement with drill string 16. Work string 30 is inserted through surface equipment 34, as is known. A pack off 36 seals the opening through which work string 30 passes.

Once the latches are disengaged from the drill string, the work string is removed from the well. The drilling assembly remains downhole. When the work string has been completely removed from the well, further joints of casing are added at surface such that the drill string of casing is advanced into the wellbore. Since drilling assembly 18 remains in the wellbore and within the distal end of the drill string, drill string 16 is moved down over the outer surface of the drilling assembly. To advance the drill string, some reaming of the casing may be required. Reaming is accomplished by rotating the drill string. The drill string is advanced to a desired position, after which the drilling assembly is removed from the wellbore.

Figure 2:
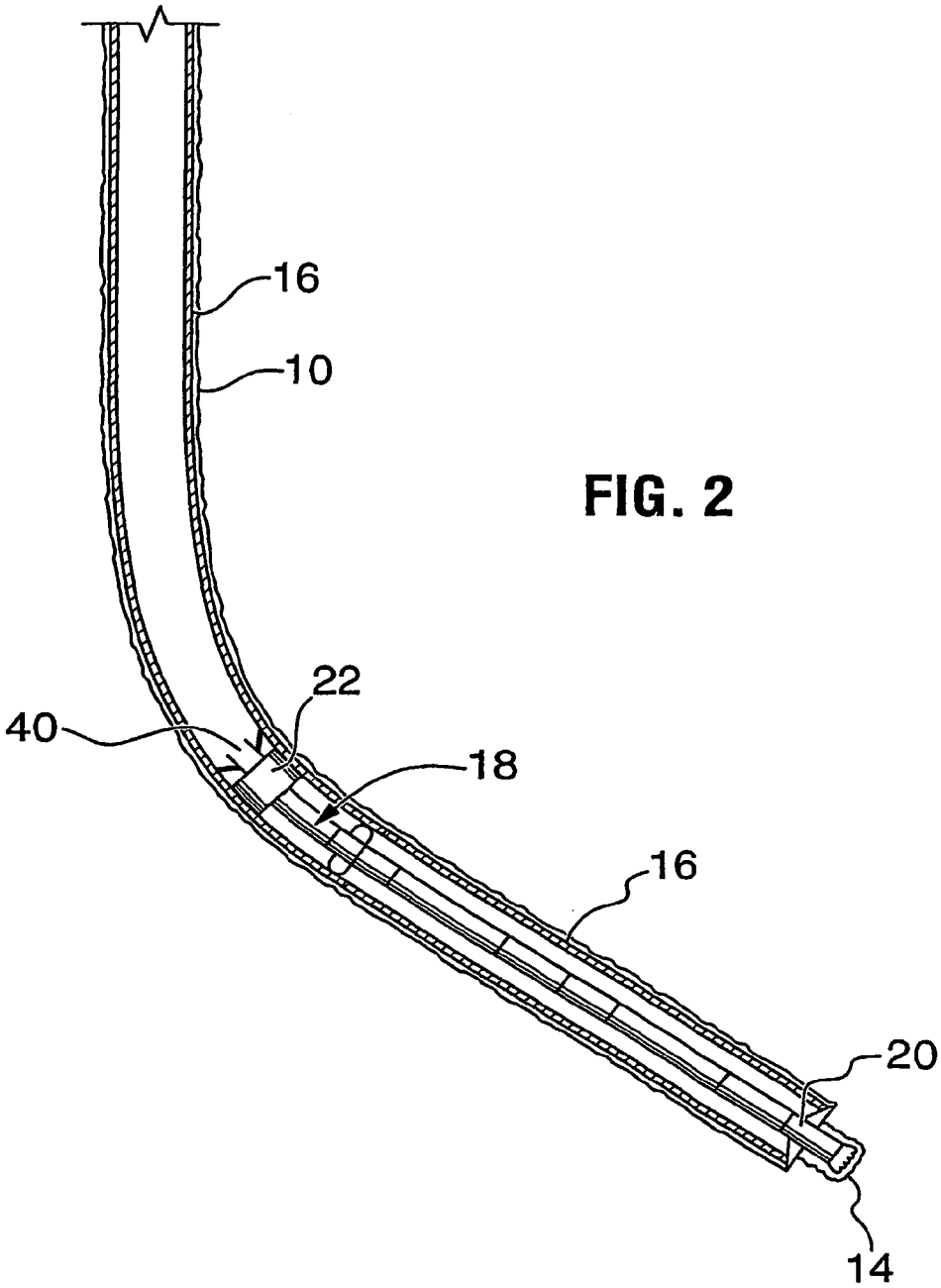
FIG. 2 shows a schematic vertical section through a well and illustrates further aspects of the present invention.

Referring now to FIG. 2, it shows a vertical section through another well in which the drill string 16 has been advanced down over the drilling assembly 18. While in FIG. 1 member 22 is actuated by a work string, in FIG. 2 member 22 is actuated by means of a fluid-conveyed dart 40 (shown in actuating position, partially inserted into member 22). Dart 40 is introduced by opening briefly the surface well head and is conveyed with drilling fluid circulation downhole. Dart 40 requires no attached rigid work string to move it along and is instead conveyed by fluid flow into engagement with the drilling assembly. As will be appreciated, the dart can be, for example, formed at its leading edge to act against and depress shoulders on member 22 that in turn cause the disengagement of the locking means on member 22 from drill string 16. The dart can carry a wireline or other string that is pulled along as the dart is conveyed by fluid pressure, if desired.

By use of dart 40, no work string is required to be used and circulation of drilling fluid can continue during the entire disengaging operation, with the exception of a short period during which the drill string is opened to introduce the dart and when joints of casing are added to the drill string.

Drill string 16 is then advanced into the well by adding additional casing joints at surface and, if necessary, rotating the casing as it is lowered into the well. As the drill string is advanced, the drilling assembly acts as a guide over which the drill string moves. The drilling assembly maintains the drill string on course in the borehole and reduces the chances of the casing being hung up on the borehole wall. Once the drill string is advanced to a desired depth (as shown), for example substantially to bottom 14 of the borehole, the drilling assembly can be retrieved to surface by use of a retrieving tool (in some circumstances also known as a fishing tool), by reverse circulation, or other by other methods. In so doing, underreamers 20 collapse to fit within drill string 16.

Figure 3A:
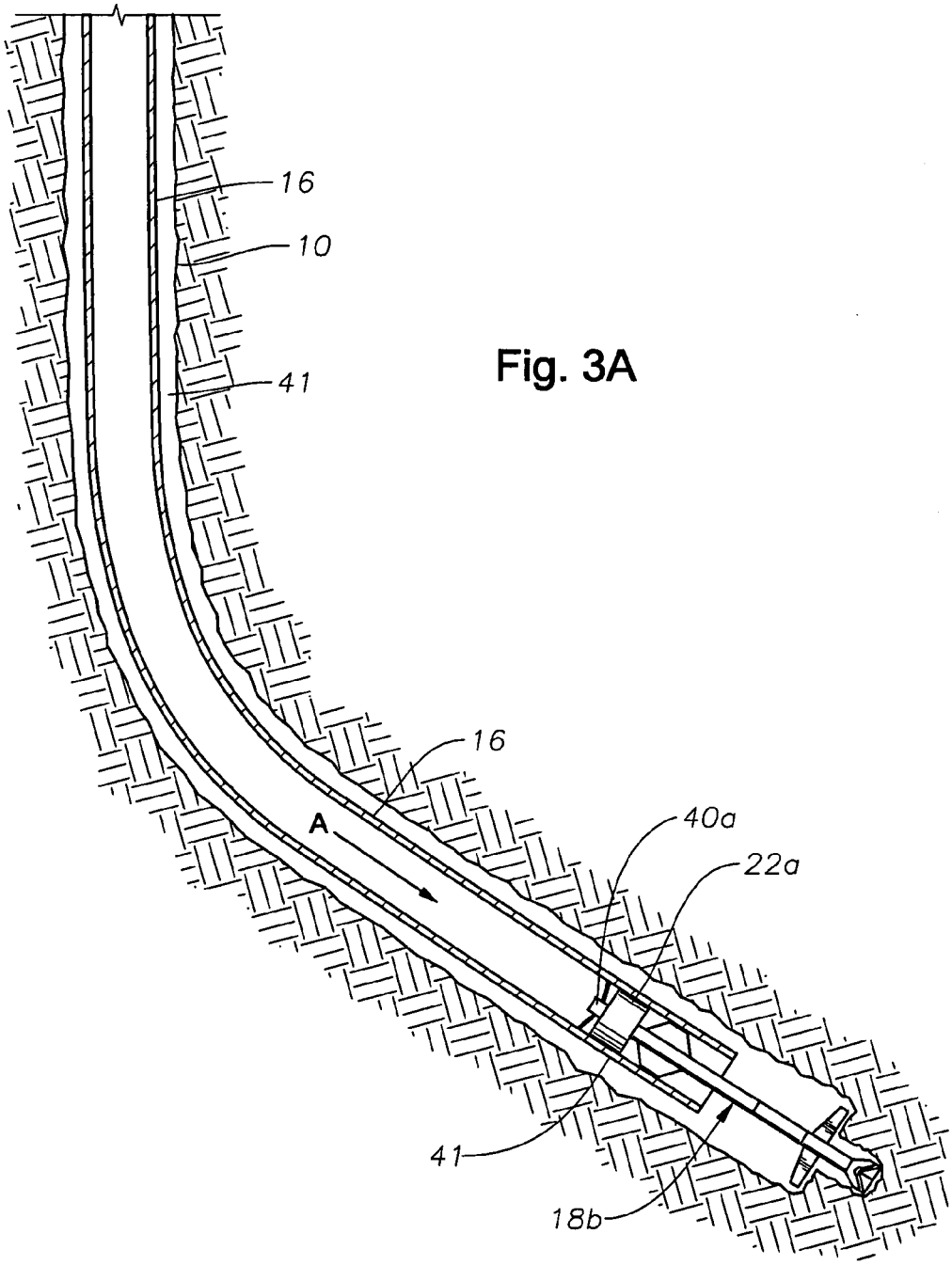
FIGS. 3A and 3B show sequential schematic vertical sections through a well and illustrates other aspects of the present invention.
Figure 3B:
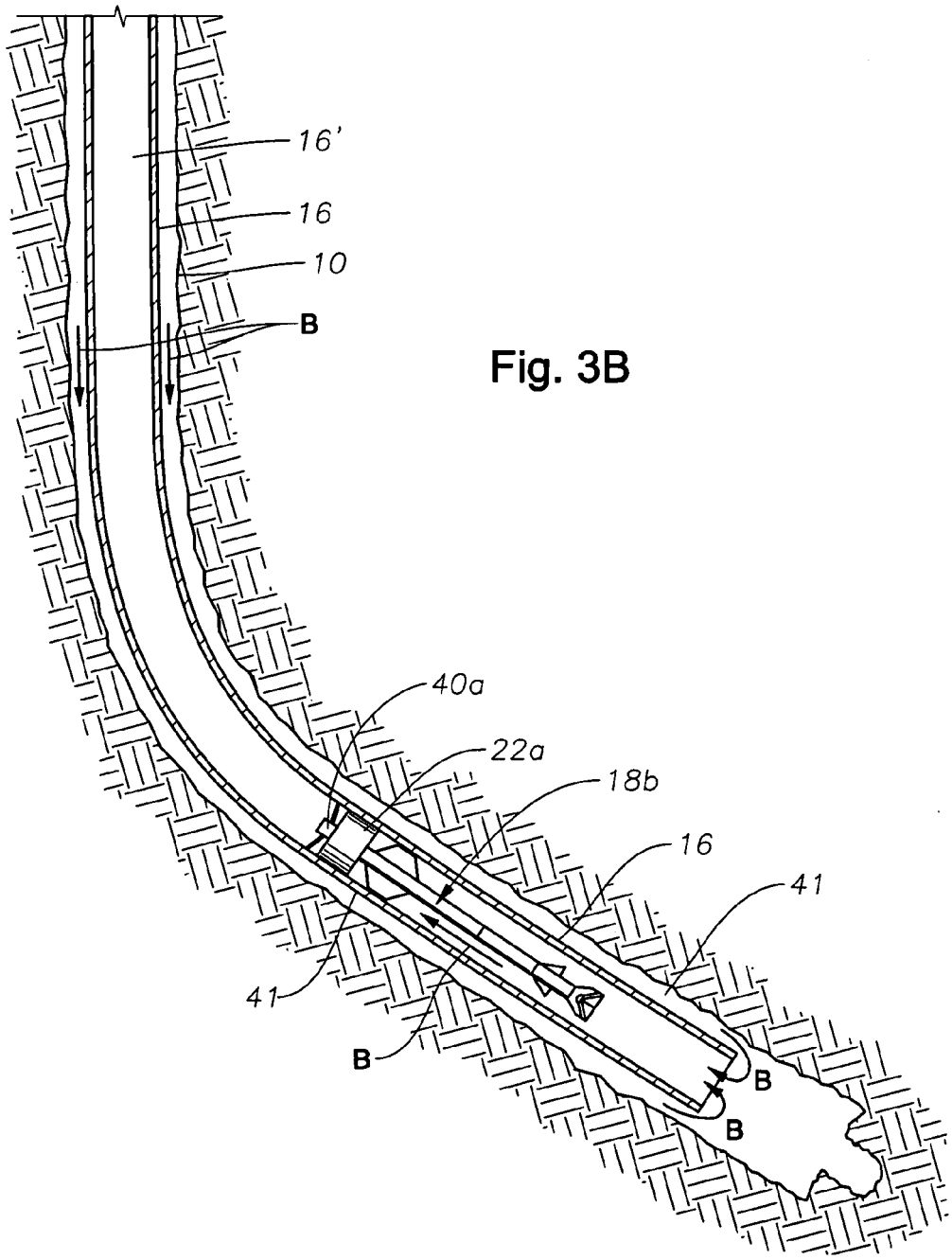

The process of retrieval of a drilling assembly 18*b* by reverse circulation is illustrated in FIGS. 3A and 3B. In the illustrated embodiment, a vertical section through another well is shown in which member 22*a* is actuated by means of a fluid-conveyed dart 40*a* (shown in FIG. 3A In actuating position, partially inserted into member 22*a*). Dart 40*a* is introduced by opening briefly the surface well head and is conveyed with drilling fluid circulation downhole. Dart 40*a* includes a seal thereabout that causes the dart to be conveyed by fluid flow along arrows A into engagement with the drilling assembly. As will be appreciated, the dart can be, for example, formed at its leading edge to act against and depress shoulders on member 22*a* that in turn cause the disengagement of the locking means on member 22*a* from drill string 16.

By use of dart 40*a*, no work string is required to be used and circulation of drilling fluid can, if desired, continue during substantially the entire conveying and disengaging operation, with the exception of a short period during which the drill string is opened to introduce the dart.

In the illustrated embodiment of FIG. 3B, the retrieval of drilling assembly 18*b* is shown by reverse circulation wherein after the drilling assembly is disengaged from drill string 16, drilling fluid is pumped down, arrows B, through the annulus 41 between drill string 16 and borehole 10 to act against the drilling assembly and force it up through the drill string toward surface. Continued reverse circulation can lift the drilling assembly so that it can be retrieved at surface. If undesirable annulus pressures are required to lift the drilling assembly through the drill string, it may be useful to reduce the fluid pressure in the string above the drilling assembly, in the area indicated by 16', as by, for example, creating suction, replacing the fluid in the string above the drilling assembly with a relatively lighter fluid, or otherwise reducing the hydrostatic head within the string.

Figure 4:
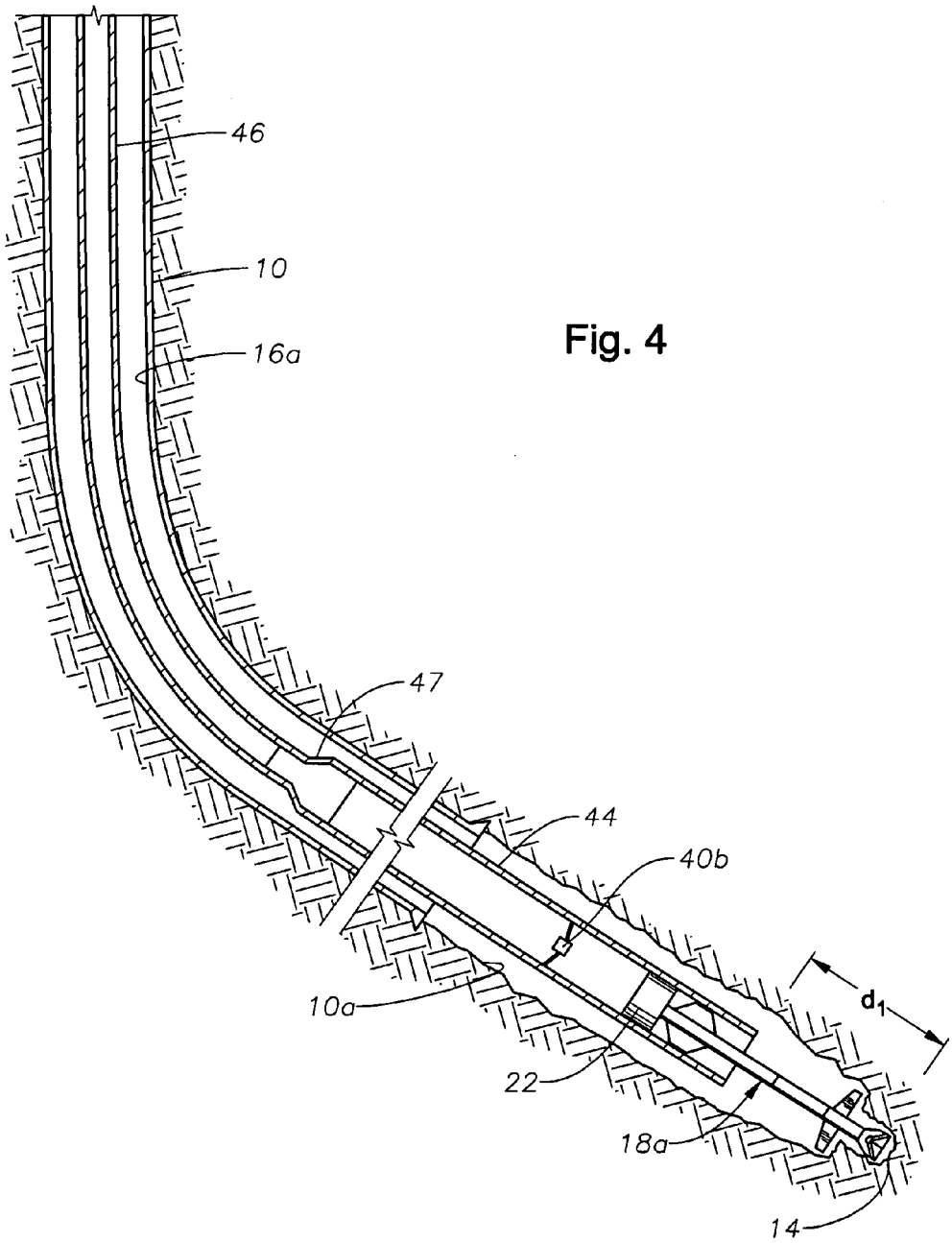
FIG. 4 shows a schematic vertical section through a well and illustrates other aspects of the present invention.

Referring to FIG. 4, another form of casing drilling is shown. The process is commonly known as liner drilling wherein a borehole 10*a* is drilled using a liner 44 with a drilling assembly 18*a* connected thereto. As will be appreciated, a liner is casing that does not extend all the way to the surface. A string of drill pipe 46 or casing is connected via a liner hanger 47 to the liner. The string of drill pipe extends to surface (not shown). During the drilling operation, advancement of liner 44 is made by adding at surface further joints of drill pipe to the drill pipe string 46. Liner drilling is usually conducted through an already drilled wellbore 10 that can be lined with casing 16a.

Drilling assembly 18*a* is engaged to the distal end of liner 44 by latches or other locking means on a lock member 22. Drilling assembly 18*a* can extend out beyond the end of liner 44 a distance d of between about 10 and 150 feet depending on the components included in the drilling assembly.

Lock member 22 can be manipulated to release from engagement with liner 44. In accordance with the present invention, when it is desired to remove the drilling assembly because, for example, one of the drilling assembly components requires maintenance/replacement or the drilling is complete, a release dart 40*b* is launched. Dart 40*b* is conveyed by a flow of fluid and acts on member 22 to cause the locking means of the member to release from engagement with the liner. Dart 40*b* can be launched from surface through drill pipe 46. Alternately, dart 40*b* can be installed downhole during the drilling operation such as, for example, in liner hanger 47. Dart 40*b* can include a bore therethrough such that the drilling fluid can pass the dart during the drilling operation. When it is desired to launch the dart, a bore sealing member such as a ball is released from surface to seat in the bore of the dart such that it is released, by fluid pressure, from its mounted position to act on the locking means of member 22.

Liner 44 can then be advanced towards borehole bottom 14 by reaming over the drilling assembly until the liner is at a desired depth. As such, drilling assembly 18*a* is positioned in part within liner 44. The drilling assembly can then be removed by disconnecting drill pipe string 46 or casing from liner 44 and removing the drill pipe string from the well. A work string (not shown) is then run in through the wellbore and into liner 44 to engage drilling assembly 18*a* and pull it to surface.

The previous description of the disclosed embodiments is provided to enable any person skilled in the art to make or use the present invention. Various modifications to those embodiments will be readily apparent to those skilled in the art, and the generic principles defined herein may be applied to other embodiments without departing from the spirit or scope of the invention. Thus, the present invention is not intended to be limited to the embodiments shown herein, but is to be accorded the full scope consistent with the claims, wherein reference to an element in the singular, such as by use of the article "a" or "an" is not intended to mean "one and only one" unless specifically so stated, but rather "one or more". All structural and functional equivalents to the elements of the various embodiments described throughout the disclosure that are know or later come to be known to those of ordinary skill in the art are intended to be encompassed by the elements of the claims. Moreover, nothing disclosed herein is intended to be dedicated to the public regardless of whether such disclosure is explicitly recited in the claims. No claim element is to be construed under the provisions of 35 USC 112, sixth paragraph, unless the element is expressly recited using the phrase "means for" or "step for".

The Embodiments of the invention in which an exclusive property or privilege is claimed are defined as follows:

1. A method for drilling a well with a well casing as at least a portion of an elongated tubular drill string and a drilling assembly retrievable from the lower distal end of the drill string without withdrawing the well casing from a wellbore being formed by the drilling assembly, the method comprising:

providing the casing as at least a portion of the drill string;

providing the drill string with the drilling assembly engaged at the distal end thereof;

with the drill string and the drilling assembly in the wellbore, driving the drilling assembly to operate at the bottom of the wellbore to extend the wellbore, the wellbore being formed having a diameter greater than the diameter of the drill string;

actuating the drilling assembly to disengage from the distal end of the drill string including launching a release tool and manipulating the drilling assembly using the release tool;

removing the drilling assembly out of the wellbore through the drill string without removing the drill string from the wellbore;

leaving the casing of the drill string in the wellbore; and wherein the release tool is fluid-conveyed.

2. The method of claim 1 wherein the release tool is launched without a connection to a work string.

3. The method of claim 1 wherein during the step of actuating the drilling assembly, fluid circulation is substantially maintained through the wellbore.

4. The method of claim 1 wherein after the step of actuating the drilling assembly, the drill string is advanced toward the bottom of the wellbore prior to removing the drilling assembly.

5. The method of claim 4 wherein the drill string is advanced substantially to the bottom of the wellbore prior to removing the drilling assembly.

6. The method of claim 1 wherein the casing is provided as the entirety of the drill string.

7. The method of claim 1 wherein the casing is a liner and is suspended on a string of drill pipe and the method further comprises releasing the drill pipe from the liner and prior to removing the drilling assembly.

8. A method for drilling a well with a well casing as at least a portion of an elongated tubular drill string and a drilling assembly retrievable from the lower distal end of the drill string without withdrawing the well casing from a wellbore being formed by the drilling assembly, the method comprising:

providing the casing as at least a portion of the drill string;

providing the drill string with the drilling assembly engaged at the distal end thereof;

with the drill string and the drilling assembly in the wellbore, driving the drilling assembly to operate at the bottom of the wellbore to extend the wellbore, the wellbore being formed having a diameter greater than the diameter of the drill string;

actuating the drilling assembly to disengage from the distal end of the drill string including launching a release tool and manipulating the drilling assembly using the release tool;

removing the drilling assembly out of the wellbore through the drill string without removing the drill string from the wellbore;

leaving the casing of the drill string in the wellbore; and wherein removing the drilling assembly includes reverse circulation of fluid down through an annulus about the drill string and up through the drill string.

9. The method of claim 8 wherein removing the drilling assembly employs a retrieving tool.

10. A method for positioning a casing string within a wellbore, the wellbore having been drilled using the casing string as at least a portion of an elongated tubular drill string and a drilling assembly connected to the drill string and retrievable from the lower distal end of the drill string without withdrawing the casing string from the wellbore being formed by the drilling assembly, the method comprising:

after drilling a wellbore, releasing the drilling assembly from engagement with the drill string including launching a release tool and manipulating the drilling assembly using the release tool;

removing the drilling assembly from the wellbore through the drill string without removing the casing string of the drill string from the wellbore; and wherein the release tool is launched without a connection to a work string.

11. The method of claim 10 wherein the release tool is gravity-conveyed.

12. The method of claim 10 wherein the release tool is fluid-conveyed.

13. The method of claim 10 wherein during the step of actuating the drilling assembly, fluid circulation is substantially maintained through the wellbore.

14. The method of claim 10 wherein removing the drilling assembly includes reverse circulation of fluid down through an annulus about the drill string and up through the drill string.

15. The method of claim 10 wherein removing the drilling assembly employs a retrieving tool.

16. The method of claim 10 wherein after the step of releasing the drilling assembly from engagement with the drill string, the drill string is advanced toward total depth.

17. The method of claim 16 wherein the drill string is advanced substantially to wellbore bottom prior to removing the drilling assembly.

18. The method of claim 10 wherein the casing string is provided as the entirety of the drill string.

19. The method of claim 10 wherein the casing string is a liner and is suspended on a string of drill pipe and the method further comprises releasing the drill pipe from the liner prior to removing the drilling assembly.

20. The method for positioning a casing string within a wellbore, the wellbore having been drilled using the casing string as at least a portion of an elongated tubular drill string and a drilling assembly connected to the drill string and retrievable from the lower distal end of the drill string without withdrawing the casing string from the wellbore being formed by the drilling assembly, the method comprising: after drilling a wellbore, releasing the drilling assembly from engagement with the drill string including launching a fluid-conveyed dart with a release functionality and manipulating the drilling assembly using the fluid-conveyed dart; and removing the drilling assembly from the wellbore through the drill string without removing the casing string portion of the drill string from the wellbore.

21. The method of claim 20 wherein during the step of actuating the drilling assembly, fluid circulation is substantially maintained through the wellbore.

22. The method of claim 20 wherein removing the drilling assembly includes reverse circulation of fluid down through an annulus about the drill string and up through the drill string.

23. The method of claim 20 wherein removing the drilling assembly employs a retrieving tool.

24. The method of claim 20 wherein after the step of releasing the drilling assembly from engagement with the drill string, the drill string is advanced toward total depth.

25. The method of claim 24 wherein the drill string is advanced substantially to wellbore bottom prior to removing the drilling assembly.

26. The method of claim 20 wherein the casing string is provided as the entirety of the drill string.

27. The method of claim 20 wherein the casing string is a liner and is suspended on a string of drill pipe and the method further comprises releasing the drill pipe from the liner prior to removing the drilling assembly.

* * * * *